United States Patent [19]

Pagani

[11] 4,184,649

[45] Jan. 22, 1980

[54] TAKING UP MACHINE FOR FABRICS OR PRODUCTS IN CONTINUOUS ROLL

[76] Inventor: Salvatorino Pagani, Via Unione 12, Lurate Caccivio (Como), Italy

[21] Appl. No.: 914,296

[22] Filed: Jun. 9, 1978

[30] Foreign Application Priority Data

Jun. 14, 1977 [IT] Italy ..... 24665 A/77

[51] Int. Cl.[2] ..... B65H 17/08

[52] U.S. Cl. ..... 242/66

[58] Field of Search ..... 242/66, 67.1 R, 67.3 R, 242/58.6, 79, 65

[56] References Cited

U.S. PATENT DOCUMENTS

| | | | |
|---|---|---|---|
| 3,104,072 | 9/1963 | Doven | 242/66 |
| 3,236,471 | 2/1966 | Hornbostel | 242/66 |
| 3,433,430 | 3/1968 | Sprague | 242/66 |

*Primary Examiner*—Edward J. McCarthy

*Attorney, Agent, or Firm*—Haseltine, Lake & Waters

[57] ABSTRACT

A machine for taking up fabrics or products in a continuous roll, comprising at least one pair of powered horizontal driving rollers arranged transversely of a vertical carrying structure provided with two parallel horizontal lower and upper rails, on which end guides can slide and seat for two grooved vertical uprights, the latter having inserted therein the ends of supporting warping woofs for fabric rolls as free to slide and rotate.

5 Claims, 5 Drawing Figures

TAKING UP MACHINE FOR FABRICS OR PRODUCTS IN CONTINUOUS ROLL

FIELD OF THE INVENTION

This invention relates to a taking up machine for paper, plastic, fabrics or similar products in a continuous roll, particularly for carrying out a taking up operation on warping woofs for said products, and in the case of fabrics received from controlling or checking operation, prior to washing and dyeing operations, and after said operations prior to so-called boating.

BACKGROUND

The taking up operation is an extremely important step in fabric processing, as productive capacity for a full processing cycle may depend thereupon.

As well known, fabrics are made on looms as rolls, wherein the so-called "height" of different size actually is the width of the fabric band.

After getting through the control or check step, said rolls are supplied on rollers or in flaps to the taking up machines which are effective to take up such rolls, as sewn to one another, in large rolls of different width, depending on the fabric height, thus preparing the same for the subsequent steps of washing, dyeing, etc.

At present this operation is performed by taking up machines having a fixed span width equal to the maximum size in height of the processed fabrics. On said machines, the central warping woof supporting pin is of a length equal to said fixed span and guided at the ends by stationary vertical guides. The machines are capable of taking up fabrics, forming rolls of various widths and having a determined maximum outer diameter. Particularly, the roll diameter, which is proportional to the footage of the taken up cloth, connot exceed a defined upper limit, otherwise the total weight on the waring woof carrying pin would be exsessive.

A further disadvantage of said known machines is that, even when the fabric rolls are of reduced width and accordingly proportionally less heavy, such rolls cannot, in any case, be taken up beyond the upper diameter limit, as at the center of said warping woof supporting pins a readily unbalanceable large mass would be created. Said mass could cause irregular violent impact on the outer bearings of the pins and driving rollers, with the hazard of a roll falling out of the machine or breakage to any component of the latter.

Because of these instability reasons, it is possible in said machines to increase the take up speed of the fabric for increase in productivity. Similar problems arise in the production and subsequent processing steps, for rolls of such materials as paper, plastic and the like.

SUMMARY OF THE INVENTION

It is an object of the present invention to provide a taking up machine which to overcomes the above mentioned disadvantages and substantially improves the productivity both for the machine and for the full processing cycle.

It is another object of the invention to provide a taking up machine, on which rolls of fabric or other material of any diameter and width can be formed without any danger to the machine and its operators and which is also easy to operate, simple to maintain and economical.

It is a further object of the invention to provide a taking up machine facilitating said operation both in preparing the fabric rolls for washing and dyeing, and in preparing for so-called boating, and which substantially reduces man operation during the cycle, while also increasing the output of the processed product.

These and other objects of the invention are accomplished by a taking up machine comprising a pair of powered horizontal driving rollers, arranged transversely of a vertical carrying structure provided with two horizontal parallel lower and upper rails, on which end guides can slide and seat for two grooved vertical uprights, the latter having inserted therein the ends of supporting warping woofs for fabric rolls free to slide and rotate.

BRIEF DESCRIPTION OF THE DRAWINGS

In order that the present invention be more clearly understood, a detailed description thereof will now be given for a particular embodiment, with reference to the accompanying drawings in which.

DETAILED DESCRIPTION

Figure 1:
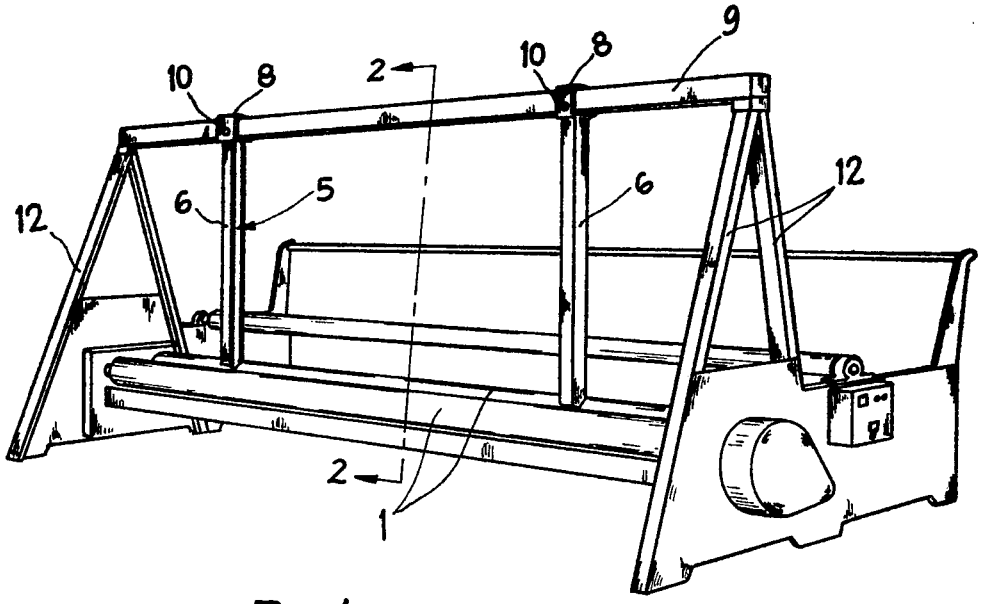
FIG. 1 is a schematic perspective view of the inventive machine as a whole.
Figure 2:
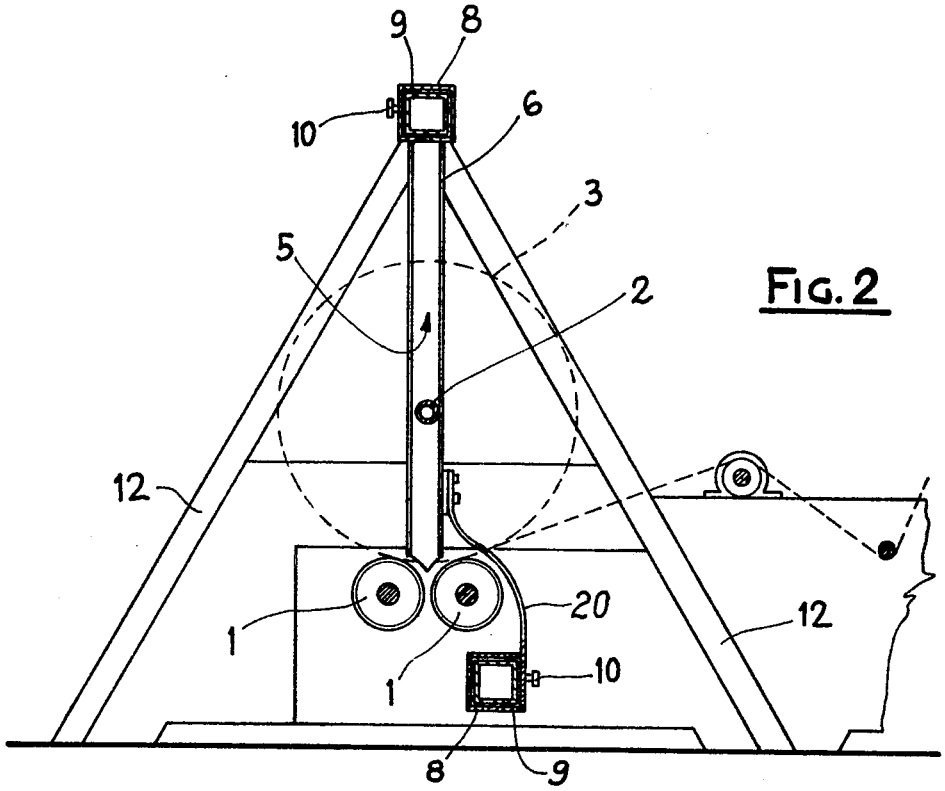
FIG. 2 is a schematic cross-sectional view of the machine shown in FIG. 1 as taken along line 2—2 in FIG. 1.
Figure 3:
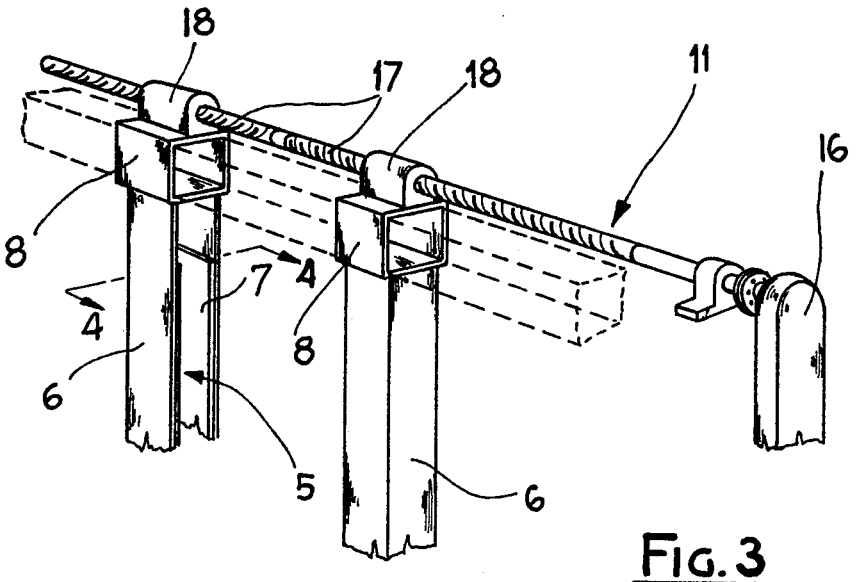
FIG. 3 is a modification of the machine in FIG. 1 and shows a powered displacing system for the vertical uprights.
Figure 4:
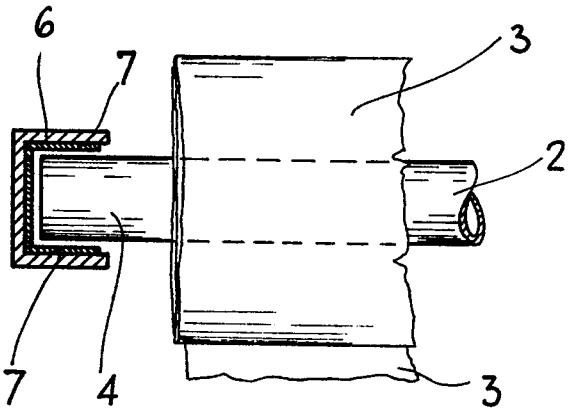
FIG. 4 is a sectional view taken along line 4—4 in FIG. 3 showing the detail for a vertical upright in which the end of a warping woof is inserted.
Figure 5:
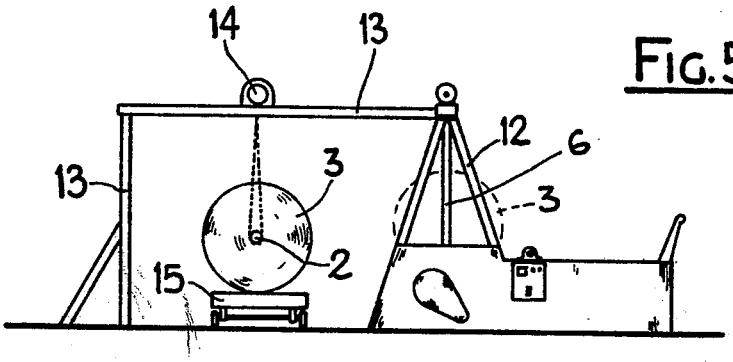
FIG. 5 is a schematic view showing a lifting, removing and loading device for the fabric rolls provided by the taking up machine.

Referring now to figures of the accompanying drawings, the two driving rollers 1 are shown, on which a warping woof 2 is carried and has attached thereto the end of a series of fabric rolls for flaps 3 as sewn to one another. During rotation, rollers 1 cause warping woof 2 to rotate and accordingly effect rolling up thereon of fabric 3 which, for example, is supplied from a production line. Lateral ends (FIG. 4) of said warping woof 2 are inserted in vertical grooves 5 of uprights 6. Such grooves 5 are coated with a layer of antifriction material in order to facilitate rotational and sliding movement of the ends 4 of said warping woof 2. At the upper and lower ends thereof, said uprights 6 are provided with guides 8 running on parallel horizontal rails 9. Particularly, the lower guides 8 are joined to the uprights by means of brackets 20 enabling an offset arrangement of the lower rail.

A suitable clamping device, comprising simple screws 10, or provided with a powered ratchet, enables positioning the uprights 6 at a predetermined location so as to be exactly at the ends of warping woofs 2 and therein accomodate the ends 4 thereof.

The powered control device may comprise a drive 16 rotably controlling a worm 17 having a double opposing thread, inserted in scrolls 18 applied to said guides 8. Therefore, regardless of projecting ends 4, said warping woofs 2 may be of the same length as the height of fabrics 3 to be taken up.

Thus, the disadvantages of conventional machines can be overcome and, additionally, the diameter of fabric rolls could be increased owing to the capability of pins 4 to freely slide upwardly within said grooved vertical uprights 6, while also the speed of rotation for the driving rollers could be increased as said uprights 6 afford a higher stability to the carrying structure.

The increase in diameter and speed produces an increase in the output or productivity, since even in the subsequent steps a larger amount of fabric can be processed for each cycle.

The fabric rolls 3, thus obtained, can reach a considerable weight and, in such a case, vertical carrying structure 12 can have a cross scaffold 13 applied thereto, a standard hoist 14 running thereon under manual or power control, and by which a finished fabric roll 3 can be lifted, carried and laid down on suitable conveying trucks 15.

From the foregoing it can be stated that the above described machine can be used either for steps preceding washing and dyeing operations, or for taking up of the fabrics after completion of the processing and prior to so-called boating operation.

While this invention has been shown and described in connection with a particular embodiment thereof relating to fabric rolls, those skilled in the art will readily understand that various changes to the structure and details can be made without departing from the scope and spirit of the invention, for example to adapt it to the case of rolls of paper, plastic, etc.

What I claim is:

1. A machine for taking up fabrics or products in a continuous roll, comprising at least one pair of powered horizontal driving rollers, wherein said rollers are arranged transversely of a vertical carrying structure provided with two parallel horizontal lower and upper rails, end guides slidably mounted on said rails, two grooved vertical uprights supported by said end guides for travel therewith, said uprights having inserted therein the ends of supporting warping woofs for fabric rolls for free slidable and rotational movement.

2. A machine according to claim 1, comprising means for moving and positioning said end guides along said rails.

3. A machine according to claim 1, wherein the grooves of said vertical uprights are coated with anti-friction material.

4. A machine according to claim 1, including means for lifting and removing the produced product rolls.

5. A machine according to claim 1 wherein the warping woofs for taking up product are directly applied between said grooved vertical uprights, said warping woofs being of a different length from one another.

* * * * *